US006431523B2

(12) United States Patent
Goldman

(10) Patent No.: US 6,431,523 B2
(45) Date of Patent: Aug. 13, 2002

(54) MANHOLE COVER REMOVING TOOL

(76) Inventor: Garrett M. Goldman, 1304 Red Baron Rd., Payson, AZ (US) 85541

( * ) Notice: Subject to any disclaimer, the term of this patent is extended or adjusted under 35 U.S.C. 154(b) by 0 days.

(21) Appl. No.: 09/771,274

(22) Filed: Jan. 26, 2001

Related U.S. Application Data

(62) Division of application No. 09/356,612, filed on Jul. 19, 1999, now Pat. No. 6,202,986.

(51) Int. Cl.[7] ..... B66F 11/00
(52) U.S. Cl. ..... 254/1; 254/131
(58) Field of Search ..... 7/143, 145, 146; 30/164.5; 125/43; 254/131, 131.5, 25, 1

(56) References Cited

U.S. PATENT DOCUMENTS 1,336,630 A * 4/1920 Kirkpatrick ..... 125/43
1,530,946 A * 3/1925 Johnson ..... 254/131
2,027,009 A * 1/1936 Wyscaver ..... 254/131
2,382,831 A * 8/1945 Tabellione ..... 254/25
5,865,425 A * 2/1999 Meadows ..... 254/131

* cited by examiner

*Primary Examiner*—Robert C. Watson
(74) *Attorney, Agent, or Firm*—Parsons & Goltry; Robert A. Parsons; Michael W. Goltry

(57) ABSTRACT

A manhole cover removing tool includes an elongated body having an upper end with a handle attached and a lower end defining a pivot area. A first elongated member is attached to the body so as to extend generally transversely therefrom in a first direction and terminate in a pointed end designed to engage an open pick hole type of manhole cover. A second elongated member is attached to the body so as to extend generally transversely therefrom in a second direction, generally opposite to the first direction, and terminate in a flattened end designed to engage a recessed pick hole type of manhole cover. In a preferred embodiment the handle, elongated body and one of the first and second elongated members are formed integrally from a single metal rod.

5 Claims, 3 Drawing Sheets

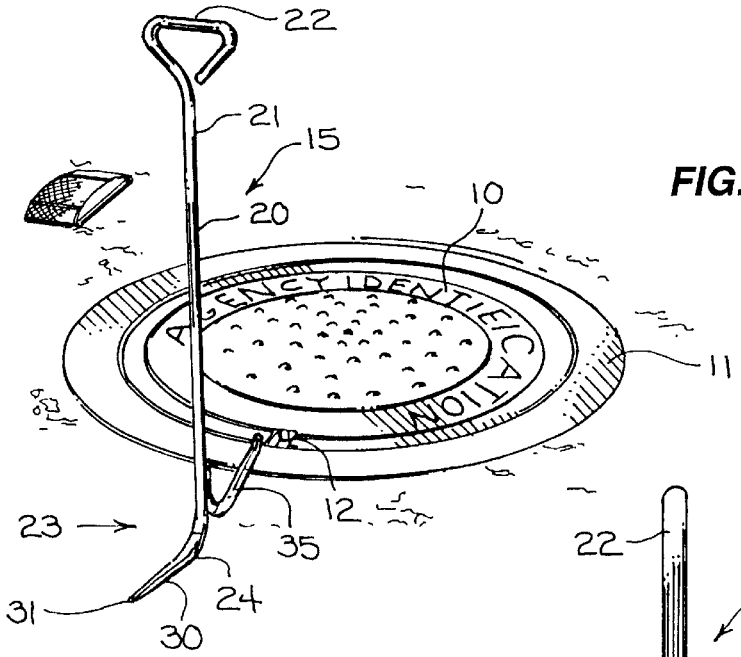
FIG. 1
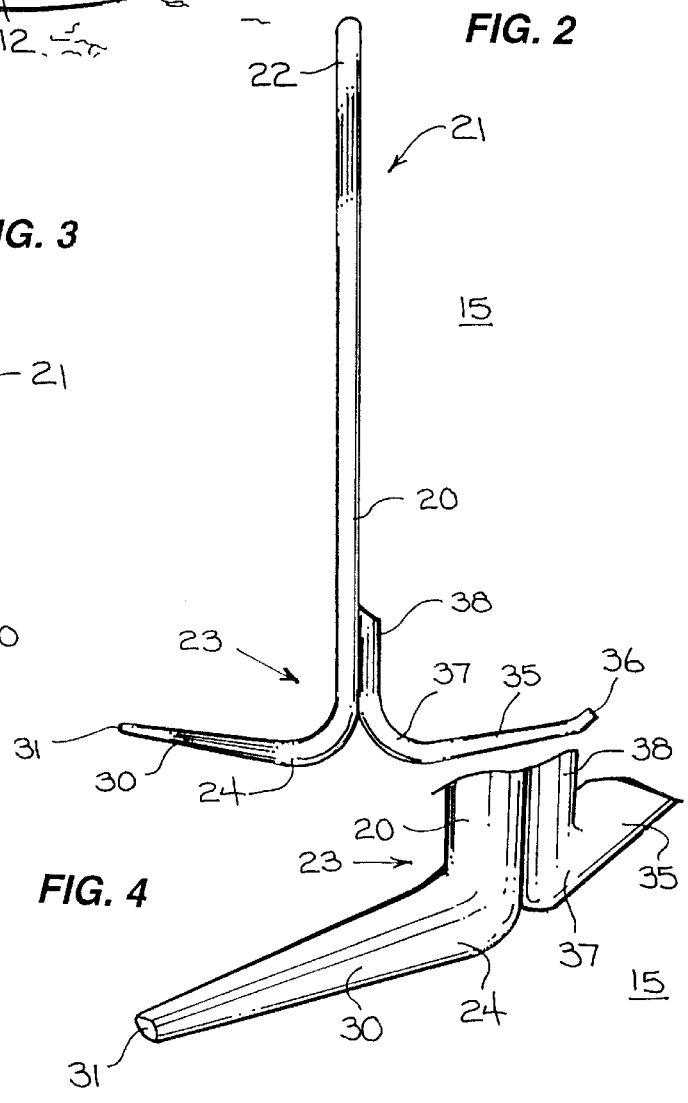
FIG. 2
FIG. 3
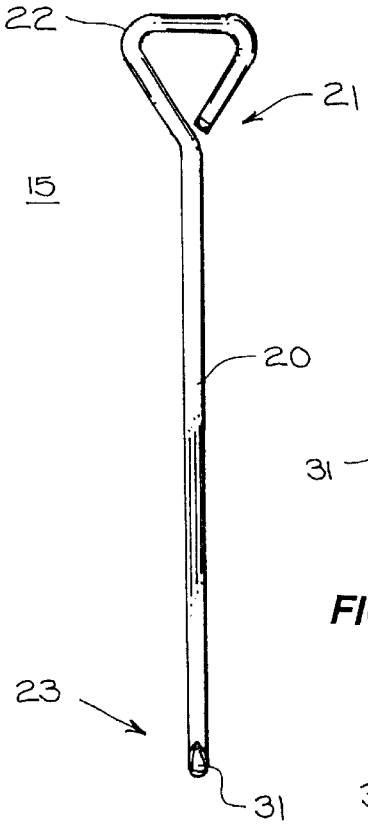
FIG. 4

MANHOLE COVER REMOVING TOOL

This application is a division of Ser. No. 09/356,612 filed Jul. 19, 1999 now U.S. Pat. No. 6,202,986.

FIELD OF THE INVENTION

This invention relates to tools for removing manhole covers.

More particularly, the present invention relates to manual tools for removing manhole covers from a manhole ring or frame.

BACKGROUND OF THE INVENTION

Two basic types of manhole covers exist. The first is the standard manhole cover that has an open pick hole. This type of pick hole is generally a slot in the side of the cover about one and one fourth inches wide and about one and one half inches long. The slot depth equals the thickness of the cover, i.e. the slot extends completely through the cover. The second type of manhole cover is used to keep surface water out of the manhole and has a recessed pick hole. The recessed pick hole is a pocket that is cast into the cover and does not completely penetrate the cover. In each instance the manhole cover fits into a manhole frame or ring which is fixedly positioned (e.g. set in concrete) in the ground surrounding the manhole. The manhole cover fits in the manhole ring so that the upper surfaces are substantially flush. Also, in both instances the standard cast iron manhole covers weigh between two hundred and three hundred pounds.

Currently, a tool to remove manhole covers exists that has a single pointed end similar to the pointed end of a standard pick. These types of manhole picks can be used with an open pick hole only. They are not used with recessed pick hole manhole covers. This type of manhole pick requires the operator to physically lift the manhole cover vertically free of the manhole ring and then pull the manhole cover to the side of the manhole. The operator usually stands right next to the manhole cover while lifting and then has to shuffle backwards to move the cover off of the manhole. During this operation, the manhole pick does not fit securely in the pick hole, opening the door for injury Two types of injuries generally occur during this operation: 1) the operator drops the manhole cover on his foot; or 2) the operator injures his back while lifting, since the standard cast iron manhole cover weighs 200 pounds or more.

Currently, there are no manhole picks being manufactured specifically for the recessed pick hole cover. Operators are substituting common tools, such as digging picks and claw hammers for this operation. It is very difficult to remove a recessed pick hole cover with these types of substitute tools. Again these types of substitute tools open the door for injuries as explained above.

What is experienced in the field is a disregard for available manhole picks because they are difficult to use and do not work well. Instead, operators are using shovels to remove manhole covers. The shovel is inserted between the manhole cover and the manhole ring. This allows the operator to tip or lever the manhole cover to one side. The operator can then grab the manhole cover with his hands and slide it off of the manhole. This works well for the removal of about ten manhole covers and then the shovel is bent and not usable. Depending upon the number of manhole covers being removed, the shovel budget gets very high in a short time. Additionally, the chances of injury are high for this operation as explained above with the added possibility of hand injuries.

It would be highly advantageous, therefore, to remedy the foregoing and other deficiencies inherent in the prior art.

Accordingly, it is an object of the present invention to provide a new and improved manhole cover removing tool.

Another object of the invention is to provide a new and improved manhole cover removing tool which is capable of being used to remove either an open pick hole type of manhole cover or a recessed pick hole manhole cover.

And another object of the invention is to provide a new and improved manhole cover removing tool which is easier and more efficient to use then prior art tools and which reduces the physical effort required during a manhole cover removing operation.

Still another object of the present invention is to provide a new and improved manhole cover removing tool which greatly reduces the possibilities of injury during a manhole cover removing operation.

Yet another object of the invention is to provide a new and improved manhole cover removing tool which reduces the number of tools required during a manhole cover removing operation.

SUMMARY OF THE INVENTION

Briefly, to achieve the desired objects of the instant invention in accordance with a preferred embodiment thereof, provided is a manhole cover removing tool including an elongated body having an upper end with a handle attached and a lower end defining a pivot area. A first elongated member is attached to the body so as to extend generally transversely therefrom in a first direction and terminate in a pointed end designed to engage an open pick hole type of manhole cover. A second elongated member is attached to the body so as to extend generally transversely therefrom in a second direction, generally opposite to the first direction, and terminate in a flattened end designed to engage a recessed pick hole type of manhole cover.

In a preferred embodiment the handle, the elongated body and one of the first and second elongated members are formed integrally from a single piece of material, such as a metal rod.

The desired objects of the instant invention are further achieved in accordance with a preferred embodiment thereof comprising a method of disengaging a manhole cover, including one of the open pick hole type and the recessed pick hole type, from a manhole ring including the steps of providing a manhole cover removing tool including an elongated body having an upper end with a handle attached and a lower end defining a pivot area, a first elongated member attached to the body so as to extend generally transversely therefrom in a first direction and terminating in a pointed end designed to engage the open pick hole type of manhole cover, and a second elongated member attached to the body so as to extend generally transversely therefrom in a second direction, generally opposite to the first direction, and terminating in a flattened end designed to engage the recessed pick hole type of manhole cover. An operator then performs the steps of determining the type of manhole cover to be disengaged and selecting the pointed end of the first elongated member for an open pick hole type of manhole cover and the flattened end of the second elongated member for a recessed pick hole type of manhole cover. The operator then performs the steps of engaging the selected one of the pointed end of the first elongated member and the flattened end of the second elongated member in the one of the open pick hole type of manhole cover and the recessed pick hole type of manhole cover, respectively, of the manhole cover to be disengaged and lifting and disengaging the manhole cover from the manhole ring.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 1 is an isometric view of an open pick hole type of manhole cover set in a manhole ring and a manhole cover removing tool embodying the present invention;

FIG. 2 is an enlarged view in side elevation of the manhole cover removing tool illustrated in FIG. 1;

FIG. 3 is a front view of the manhole cover removing tool illustrated in FIG. 2;

FIG. 4 is an enlarged isometric view of an elongated member of the manhole cover removing tool illustrated in FIG. 2 with a pointed end designed to engage the open pick hole type of manhole cover;

DETAILED DESCRIPTION OF THE PREFERRED EMBODIMENTS

Figure 6:
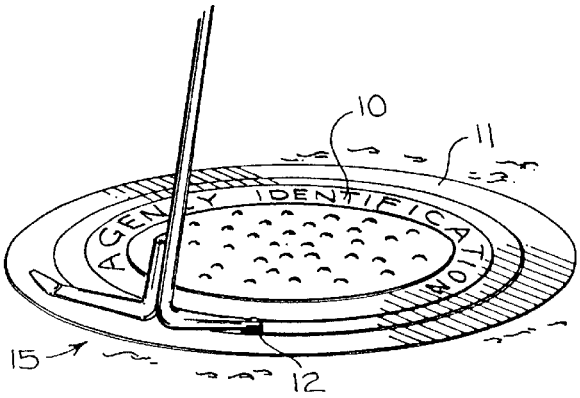
FIGS. 6, 7, and 8 are sequential isometric views of various steps in the operation of removing an open pick hole type of manhole cover.
Figure 5:
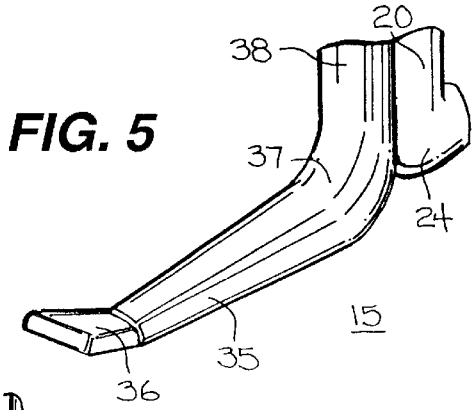
FIG. 5 is an enlarged isometric view of another elongated member of the manhole cover removing tool illustrated in FIG. 2 with a flattened end designed to engage the recessed pick hole type of manhole cover.

Turning now to the drawings in which like reference characters indicate corresponding elements throughout the several views, attention is first directed to FIG. 1 which illustrates an open pick hole type of manhole cover 10 set in a manhole ring 11 and a manhole cover removing tool, generally designated 15, embodying the present invention. Manhole cover 10 has an open pick hole 12 which extends completely through the cover at the outer periphery of manhole cover 10 adjacent to manhole ring 11.

Referring additionally to FIGS. 2 through 5, manhole cover removing tool 15 includes an elongated body 20 having an upper end 21 with a handle 22 attached and a lower end 23 defining a pivot area 24. An elongated member 30 is attached to body 20 so as to extend generally transversely therefrom in a first direction and terminating in a pointed end 31 designed to engage open pick hole 12 of manhole cover 10. Another elongated member 35 is attached to body 20 so as to extend generally transversely therefrom in a second direction, generally opposite to the first direction, and terminating in a flattened end 36 designed to engage a recessed pick hole type of manhole cover (to be explained presently).

In a preferred embodiment, body 20 is formed of a continuous piece of material, which includes an elongated metal rod, bent at an angle of slightly greater than ninety degrees at the juncture between body 20 and elongated member 30 to form pivot area 24. Also, the continuous piece of material, forming body 20 and elongated member 30, is bent adjacent upper end 21 to form handle 22. By forming body 20, handle 22 and elongated member 30 from one integral piece, tool 15 can be easily manufactured and can be formed light and very strong. In this preferred embodiment, elongated member 35 is formed from an elongated metal rod with a bent portion (slightly greater than ninety degrees) forming a pivot area 37 and a body portion 38 affixed in parallel relationship to body 20. Generally, the continuous piece of material, forming body 20 and elongated member 30 and the elongated metal rod forming elongated member 35 are both formed of a good quality steel for strength and body portion 38 of elongated member 35 is affixed to body 20 by welding or the like. It will of course be understood that other shapes and materials can be utilized and they will come within the scope of this invention.

Figure 7:
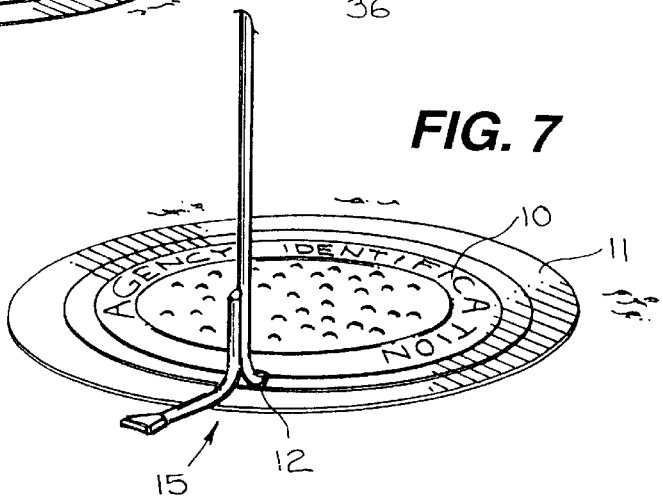
Figure 8:
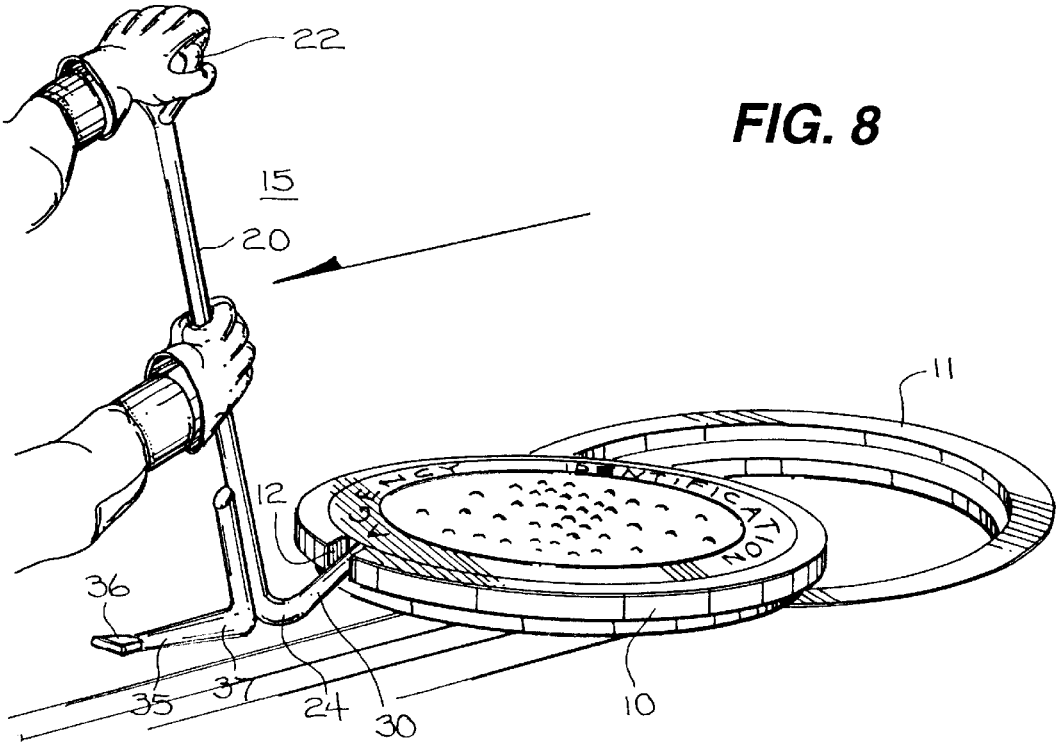

Turning now to FIGS. 6, 7, and 8 sequential views of various steps in the operation of removing open pick hole type of manhole cover 10 from a manhole defined by manhole ring 11 are illustrated. In a first step, illustrated in FIG. 6, elongated member 30 is positioned with pointed end 31 adjacent to open pick hole 12 of manhole cover 10. Pointed end 31 is inserted into open pick hole 12 of manhole cover 10 (illustrated in FIG. 7) and force is applied to tool 15 so as to pivot it about pivot point 24, or pivot point 37 if elongated member 30 is inserted substantially completely into open pick hole 12. The pivotal movement of tool 15 about either pivot point 24 or 37 lifts an edge of manhole cover 10 above manhole ring 11. At this point, manhole cover 10 is free to be dragged from its overlying position with manhole ring 11. This can be easily accomplished by simply pulling tool 15 in a backward direction as illustrated in FIG. 8 while holding manhole cover 10 in the upwardly tilted or lifted orientation. During this operation all of the weight of manhole cover 10 is resting on tool 15 which is in turn positioned with one of the pivot points 24 or 37 on the ground. Thus, no part of the operators body need be positioned where manhole cover 10 could cause injury. Also, the weight of manhole cover 10 is carried by tool 15 so that the operator incurs no danger of an injured back, etc.

Figure 9:
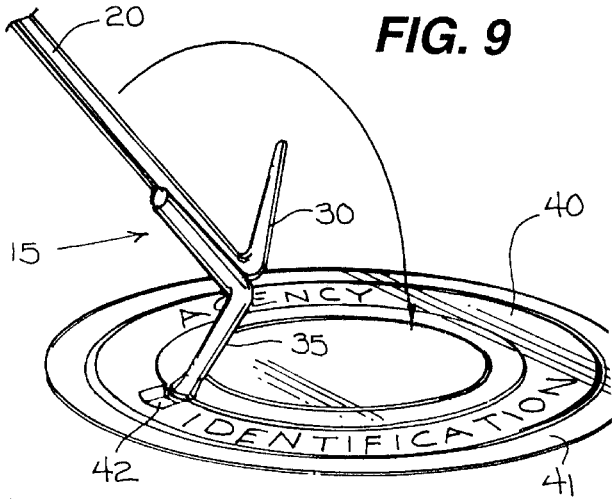
FIGS. 9, 10, and 11 are sequential isometric views of various steps in the operation of removing a recessed pick hole type of manhole cover.
Figure 10:
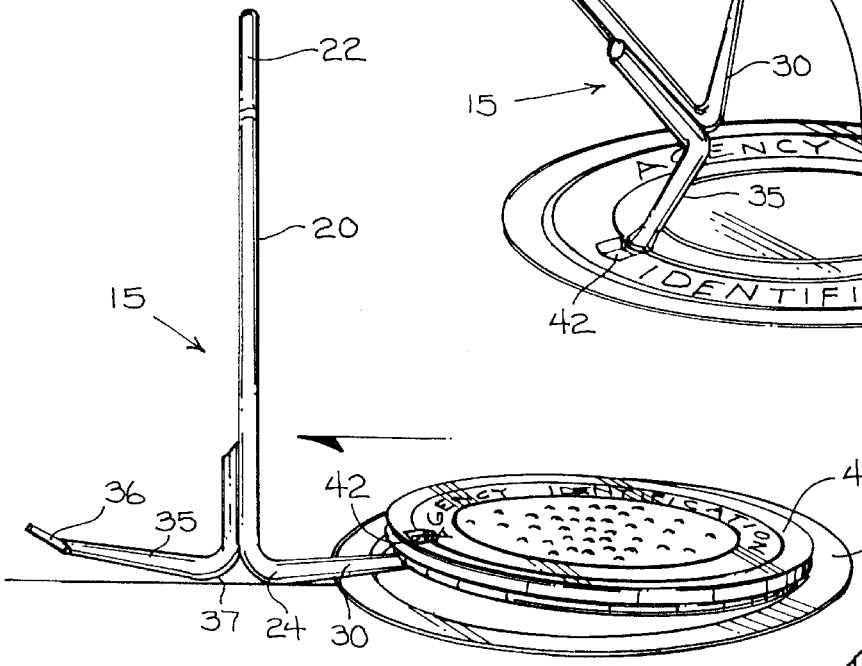
Figure 11:
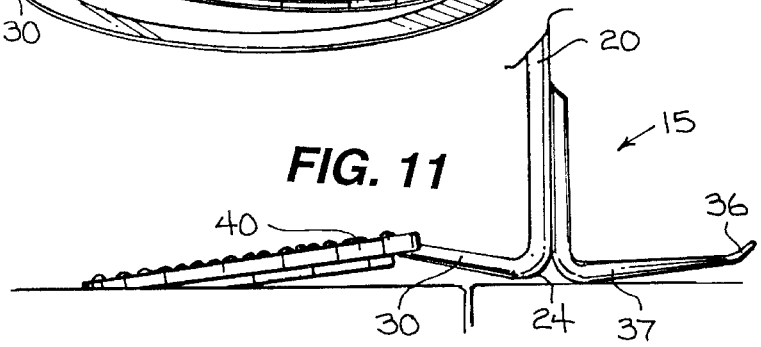

Turning now to FIGS. 9, 10, and 11, various steps in an operation of removing a recessed pick hole type of manhole cover, designated 40, are illustrated. As explained above, manhole cover 40 is positioned in a manhole ring 41 so that the upper surfaces are substantially flush. Manhole cover 40 includes a recessed pick hole 42 which is formed as a depression in the upper surface that does not extend through manhole cover 40. One upper edge of recessed pick hole 42 has a lip extending outwardly over a portion of the opening so as to provide a purchase for lifting manhole cover 40. As illustrated specifically in FIG. 9, tool 15 is manipulated so that flattened end 36 of elongated member 35 is inserted into recessed pick hole 42 and engaged under the lip described above. An upward force is then applied to tool 15 so that manhole cover 40 is lifted free of manhole ring 41. This can be accomplished, for example, by standing astraddle manhole cover 40 and simply lifting straight up. Once manhole cover 40 is disengaged from manhole ring 41, pointed end 31 is inserted beneath manhole cover 40 (illustrated in FIG. 10) and force is applied to tool 15 so as to pivot it about pivot point 37, or pivot point 24 if elongated member 30 is inserted substantially completely beneath manhole cover 40. The pivotal movement of tool 15 about either pivot point 24 or 37 maintains an edge of manhole cover 40 above manhole ring 41 as illustrated in FIG. 11. At this point, manhole cover 40 is free to be dragged from its overlying position with manhole ring 41. This can be easily accomplished by simply pulling tool 15 in a backward direction as explained previously while holding manhole cover 40 in the upwardly tilted or lifted orientation.

Thus, the new and improved manhole cover removing tool is designed to remove both open pick hole and recessed pick hole manhole covers with its dual sides. This allows operators to carry one manhole cover removing tool, eliminating multiple tools for the same job. Also, the novel design of the new and improved manhole cover removing tool gives an operator a pivot point to both lift and slide a manhole cover off of the manhole in one operation during removal of open pick hole manhole covers. This eliminates the need to physically lift the manhole cover and substantially reduces the possibility of injuries described above. The operator is never required to place body parts (e.g. fingers, etc.) under a lifted manhole cover, thus eliminating the possibility of injury by dropping the manhole cover on the operator.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A method of disengaging a manhole cover, including one of the open pick hole type and the recessed pick hole type, from a manhole ring comprising the steps of:

providing a manhole cover removing tool including an elongated body having an upper end with a handle attached and a lower end defining a pivot area, a first elongated member attached to the body so as to extend generally transversely therefrom in a first direction and terminating in a pointed end designed to engage the open pick hole type of manhole cover, and a second elongated member attached to the body so as to extend generally transversely therefrom in a second direction, generally opposite to the first direction, and terminating in a flattened end designed to engage the recessed pick hole type of manhole cover;

determining the type of manhole cover to be disengaged and selecting the pointed end of the first elongated member for an open pick hole type of manhole cover and the flattened end of the second elongated member for a recessed pick hole type of manhole cover;

engaging the selected one of the pointed end of the first elongated member and the flattened end of the second elongated member in the one of the open pick hole type of manhole cover and the recessed pick hole type of manhole cover, respectively, of the manhole cover to be disengaged; and lifting and disengaging the manhole cover from the manhole ring.

2. The method of claim 1 wherein the engaging and rotating steps include engaging the pointed end of the first elongated member in the open pick hole type of manhole cover and rotating the elongated body about the pivot area to lift and disengage the manhole cover from the manhole ring and include in addition the step of using the manhole cover removing tool with the open pick hole type of manhole cover in a lifted position to drag the open pick hole type of manhole cover from the manhole ring.

3. The method of claim 2 wherein the step of using the manhole cover removing tool to drag the open pick hole type of manhole cover from the manhole ring includes resting the manhole cover removing tool on the pivot area with the manhole cover removing tool rotated about the pivot area so that the open pick hole type of manhole cover is in the lifted position and sliding the manhole cover removing tool horizontally away from the manhole ring.

4. The method of claim 1 wherein the engaging and rotating steps include engaging the flattened end of the second elongated member in the recessed pick hole type of manhole cover and lifting and disengaging the recessed pick hole type of manhole cover from the manhole ring and include in addition the step of disengaging the flattened end of the second elongated member from the recessed pick hole type of manhole cover subsequent to lifting and disengaging the manhole cover from the manhole ring and engaging the pointed end of the first elongated member under the manhole cover and moving the manhole cover from the manhole ring.

5. The method of claim 4 wherein the step of engaging the pointed end of the first elongated member under the recessed pick hole type of manhole cover and moving the recessed pick hole type of manhole cover from the manhole ring includes resting the manhole cover removing tool on the pivot area with the manhole cover removing tool rotated about the pivot area so that the recessed pick hole type of manhole cover is in the lifted position and sliding the manhole cover removing tool horizontally away from the manhole ring.

* * * * *